US012631423B2

(12) United States Patent
Freeman

(10) Patent No.: US 12,631,423 B2
(45) Date of Patent: May 19, 2026

(54) FIREARM STOCK

(71) Applicant: Magpul Industries Corp., Austin, TX (US)

(72) Inventor: Zachary Freeman, Westminster, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/811,405

(22) Filed: Aug. 21, 2024

(65) Prior Publication Data

US 2025/0067538 A1 Feb. 27, 2025

Related U.S. Application Data

(60) Provisional application No. 63/520,726, filed on Aug. 21, 2023.

(51) Int. Cl.
*F41C 23/22* (2006.01)
*F41C 23/14* (2006.01)

(52) U.S. Cl.
CPC ..... *F41C 23/22* (2013.01); *F41C 23/14* (2013.01)

(58) Field of Classification Search
CPC ..... F41C 23/22; F41C 23/14
See application file for complete search history.

(56) References Cited

U.S. PATENT DOCUMENTS

| | | | | |
|---|---|---|---|---|
| 6,032,397 | A | 3/2000 | Iannetta | |
| 8,327,568 | B1 * | 12/2012 | Lavergne | F41C 23/22 42/72 |
| 10,302,387 | B2 | 5/2019 | Doty et al. | |
| 10,739,106 | B2 | 8/2020 | Kronengold et al. | |
| 11,137,230 | B2 | 10/2021 | Doty et al. | |
| 11,573,065 | B2 | 2/2023 | Kronengold et al. | |
| 2018/0231348 | A1 * | 8/2018 | Whelan | F41C 23/22 |

OTHER PUBLICATIONS

Accurate-Mag, "Evo Buttstock for Marlin 1894", available online at <https://accurate-mag.com/shop/experimental/evo-buttstock-for-marlin-1894/,> retrieved on Dec. 22, 2025, 3 pages.
Chisel, "Marlin Aluminum Stock", available online at: <https://chiselmachining. com/product/marlin-aluminum-stock/>, retrieved on Dec. 22, 2025, 3 pages.
Form Rifle Stocks, "Marlin Lever Action—Black Edition Stocks", available online at: <https://formriflestocks.co.uk/product/marlin-lever-action-black-edition-stocks/>, retrieved on Dec. 22, 2025, 8 pages.
Magpul, "X-22 Backpacker Stock—Ruger@ 10/22 Takedown(Registered)", Available online at: <https://magpul.com/x-22-backpacker-stock-ruger-10-22-takedown.html?mp_global_color=118>, retrieved on Dec. 22, 2025, pp. 1-6.

(Continued)

*Primary Examiner* — J. Woodrow Eldred
(74) *Attorney, Agent, or Firm* — NOD Law PC

(57) ABSTRACT

A firearm stock includes a comb and a storage cavity that includes an opening extending through at least a portion of the comb. A storage lid is configured to at least partially cover the opening, wherein the storage lid has an open position and a closed position. In some embodiments, a cheek riser is attached to the storage lid. Other firearm stocks and firearm stock accessories are disclosed.

21 Claims, 16 Drawing Sheets

(56) References Cited

OTHER PUBLICATIONS

Marlin, "Introducing the First Ruger-Made Marlin (Registered) Firearm", available online at: <https://www.marlinfirearms.com/s/model_1895sbl/>, retrieved on Dec. 22, 2025, 10 pages.
Marlin, "Lever-Action Rifles", available online at: <https://www.marlinfirearms.com/s/leverAction/>, retrieved on Dec. 22, 2025, 5 pages.
Ranger Point Marlin M-LOK Adjustable Pistol Grip Stock, avaialble online at : <https://maddogsgunsandgear.com/product/ranger-point-precision-marlin-m-lok-adjustable-pistol-grip-stock/>, retrieved on Jan. 7, 2026, 15 pages.
Tactaload (Registered), "FLASH-5 Gunstock (Black)", available online at: <https://tactaload.com/product/gunstock/>, 2025, 2 pages.
Wikipedia, "Springfield Armory M6 Scout", available online at: <https://en.wikipedia.org/wiki/Springfield_Armory_M6_Scout>, retrieved on Decemer 22, 2025, 2 pages.

* cited by examiner

FIREARM STOCK

CLAIM OF PRIORITY UNDER 35 U.S.C. § 119

The present application for patent claims priority to Provisional Application No. 63/520,726 entitled "FIREARM STOCK ATTACHMENTS" filed Aug. 21, 2023, and assigned to the assignee hereof and hereby expressly incorporated by reference herein.

FIELD OF THE DISCLOSURE

The present disclosure relates generally to components associated with firearm stocks. In particular, but not by way of limitation, the present disclosure relates to systems, methods and apparatuses for stocks that have storage cavities with a releasable lid and ambidextrous buttons to release the lid, and/or for a spacer or spacers to adjust a length of pull, and/or for a cheek height riser system.

BACKGROUND

Firarms, such as rifles and shotguns, often include two gunstock portions, e.g., a butt stock portion located at the rear end of the gun, which the shooter may grasp with one hand and place against a shoulder during the aiming and firing of the gun, and a forend (also referred to as handguard portion, which is typically located below the barrel of the gun and ahead of its receiver). The shooter may position his or her cheek on a comb portion of the gunstock, which is an upper portion of the stock forward of the butt stock portion. By positioning his or her head on the comb, the shooter is able to have a clear view of aiming sights along the barrel of the firearm for accurate shooting. The comb may be adjustable to accommodate different sizes of shooters and different optics that may be attached to the firearms.

BRIEF SUMMARY

In some aspects, a firearm stock includes a comb; a storage cavity comprising an opening extending through at least a portion of the comb; and a storage lid configured to at least partially cover the opening, wherein the storage lid has an open position and a closed position relative to the opening.

In other aspects, a firearm stock includes a storage cavity comprising an opening; a storage lid configured to at least partially cover the opening; and a cheek riser attached to the storage lid, wherein the storage lid has an open position and a closed position, and wherein the storage lid at least partially covers the opening when the storage lid is in the closed position.

In yet other aspects, a firearm stock includes a comb; a storage cavity comprising an opening extending through at least a portion of the comb; a storage lid having an open position and a closed position, wherein the storage lid at least partially covers the opening when the storage lid is in the closed position; a pivot mechanism coupled to the storage lid, the pivot mechanism configured to enable the storage lid to pivot between the open position and the closed position; and a cheek riser attached to the storage lid.

DETAILED DESCRIPTION

Figure 1:
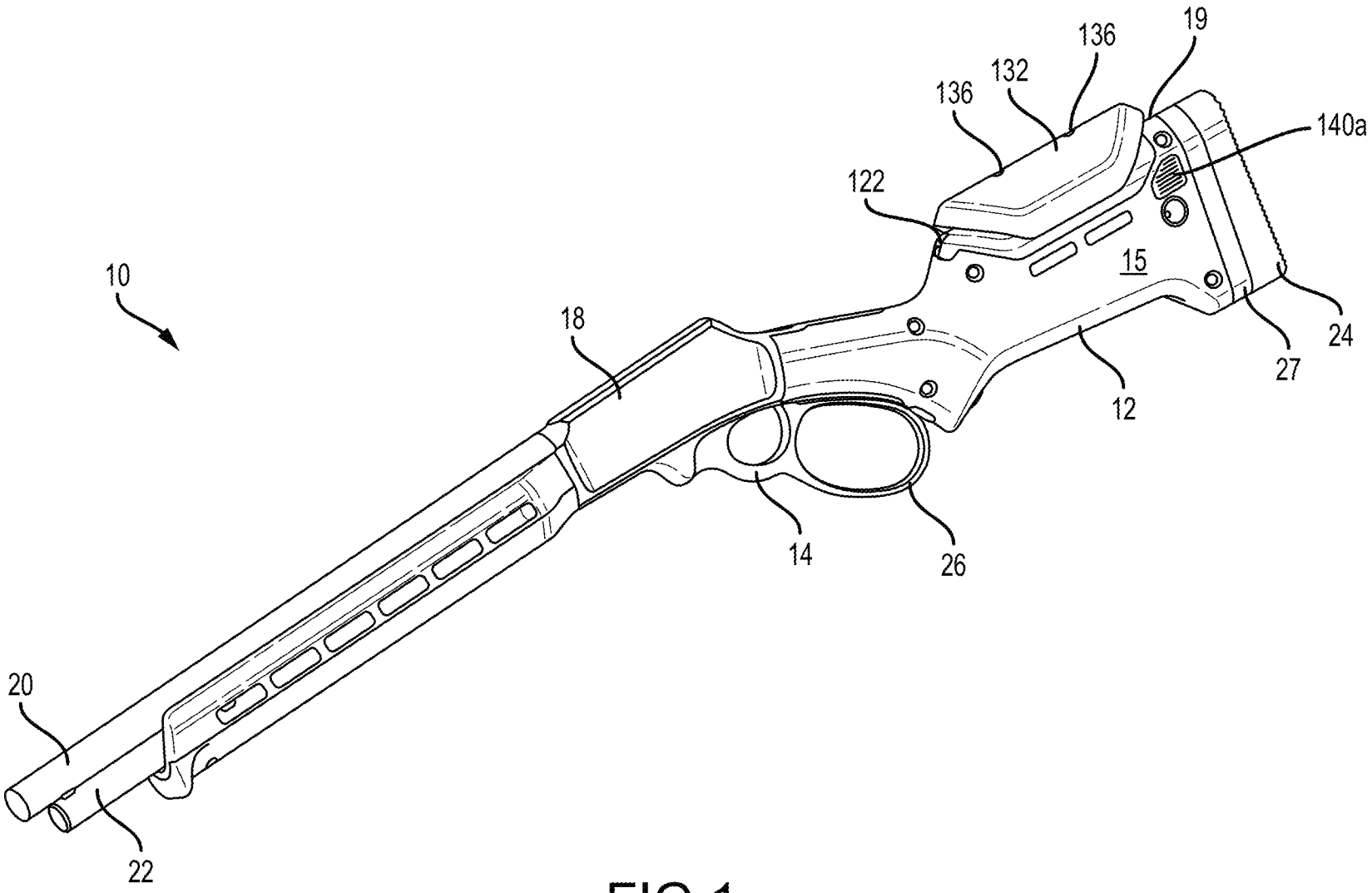
FIG. 1 is an upper, front, left-side perspective illustrative view of a firearm incorporating example embodiments of a firearm stock and associated components.

The present disclosure relates generally to components associated with firearm stocks (sometimes referred to herein simply as, "stocks"). More specifically, but without limitation, the present disclosure relates to systems, methods and apparatuses for stocks that have storage cavities with releasable lids and ambidextrous buttons, and/or a spacer or spacers to adjust a length of pull, and/or for a cheek height riser system.

The word "exemplary" is used herein to mean "serving as an example, instance, or illustration." Any embodiment described herein as "exemplary" is not necessarily to be construed as preferred or advantageous over other embodiments.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 2:
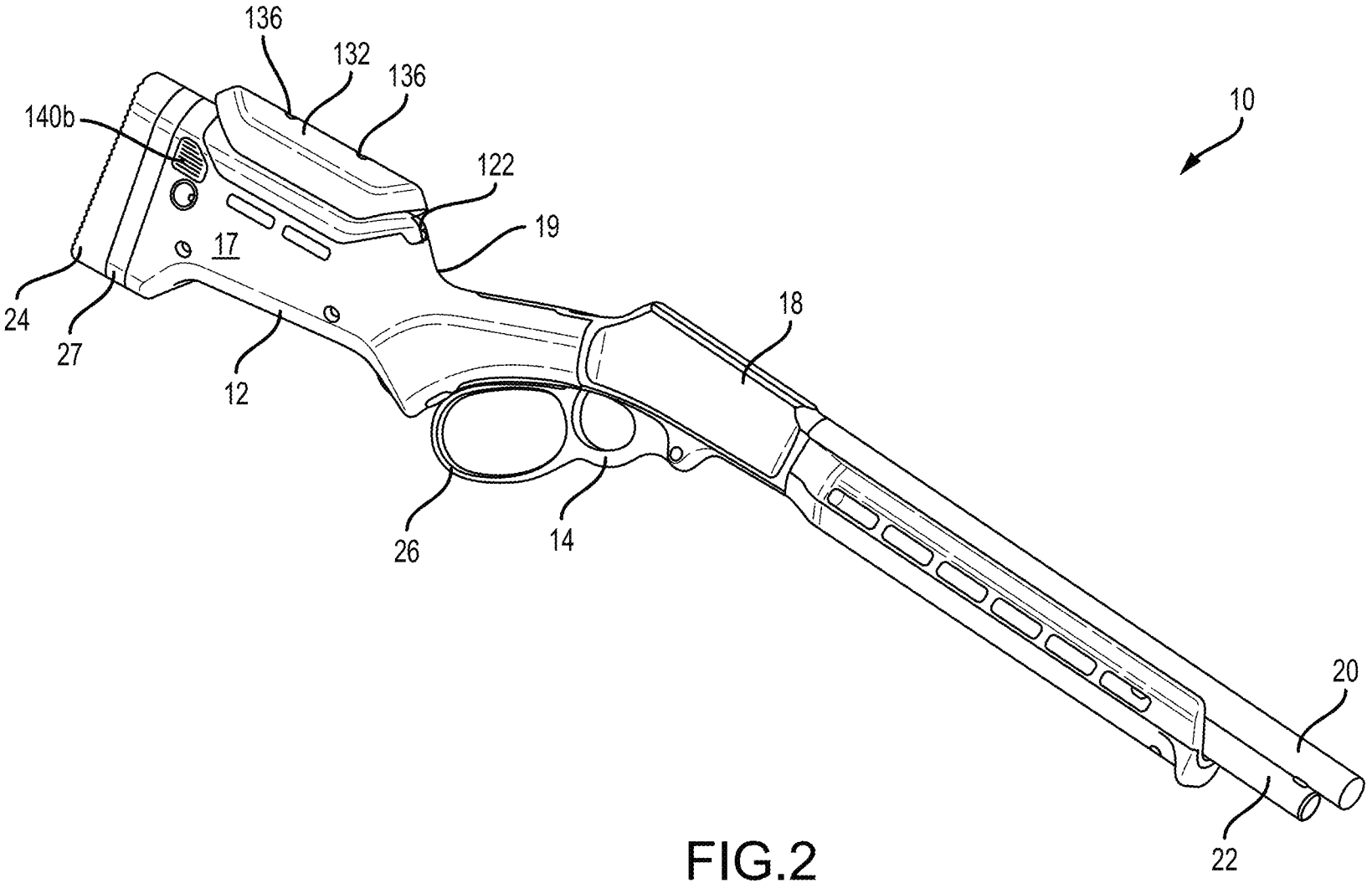
FIG. 2 is an upper, front, right-side perspective illustrative view of the firearm and example embodiments of the firearm stock and associated components of FIG. 1.

FIG. 1 is an upper, front, left-side perspective illustrative view of an example firearm 10 incorporating an example embodiment of a firearm stock 12. FIG. 2 is an upper, front, right-side perspective illustrative view of the firearm 10 and example embodiments of the firearm stock 12 of FIG. 1. FIGS. 3A-3D are, respectively, top plan, left-side elevation, bottom plan, and right-side elevation illustrative views of the firearm 10 and example embodiments of the firearm stock 12.

In the particular embodiments of FIGS. 1, 2 and 3A-3D, the firearm 10 comprises a lever-action firearm, but it should be understood that the embodiments of firearm stock 12 including associated components described herein are also suitable for advantageous use with other types of firearms, e.g., single shot, pump action, semiautomatic and fully automatic rifles, shotguns, pump-action shotguns, pistols or handguns, machine guns, machine pistols, and the like. Associated components of the firearm stock 12 may be fully or partially incorporated into components of the firearm stock 12 and/or components interfacing with the firearm stock 12, or other components of the firearm 10.

As illustrated in FIGS. 1-3D, the example firearm 10 comprises the firearm stock 12, a trigger guard 14 for guarding a trigger (not shown), a lever 26 for manually cocking the firearm 10, a receiver 18, and an elongated, generally cylindrical barrel 20 and tubular magazine 22 (also referred to as a magazine tube) protruding forwardly from a front end of the receiver 18. As illustrated, in some embodiments, a storage lid 122 (e.g., to a storage cavity 120) may be attached to the firearm stock 12 where the storage lid 122 may interface with a cheek riser 132 attached via screws 136 to the storage lid 122. Other devices may be used to couple the cheek riser 132 to the storage lid 122. A spacer 27 and a recoil pad 24 can be disposed at a rear end of the firearm stock 12 (also referred to as a buttstock or shoulder stock).

The firearm stock 12 may have a first side 15 (e.g., a left side) and a second side 17 (e.g., a right side) located opposite the first side 15. The firearm stock 12 may have a comb 19 located between the first side 15 and the second side 17. The comb 19 may be a location where a shooter places his or her cheek when using a firearm that does not include a cheek riser such as the cheek riser 132. A storage lid 122 may cover at least a portion of the comb 19 or may be integral with the comb 19 when the storage lid 122 is in a closed position as described herein and as shown in FIGS. 1-3D.

Figure 3A:
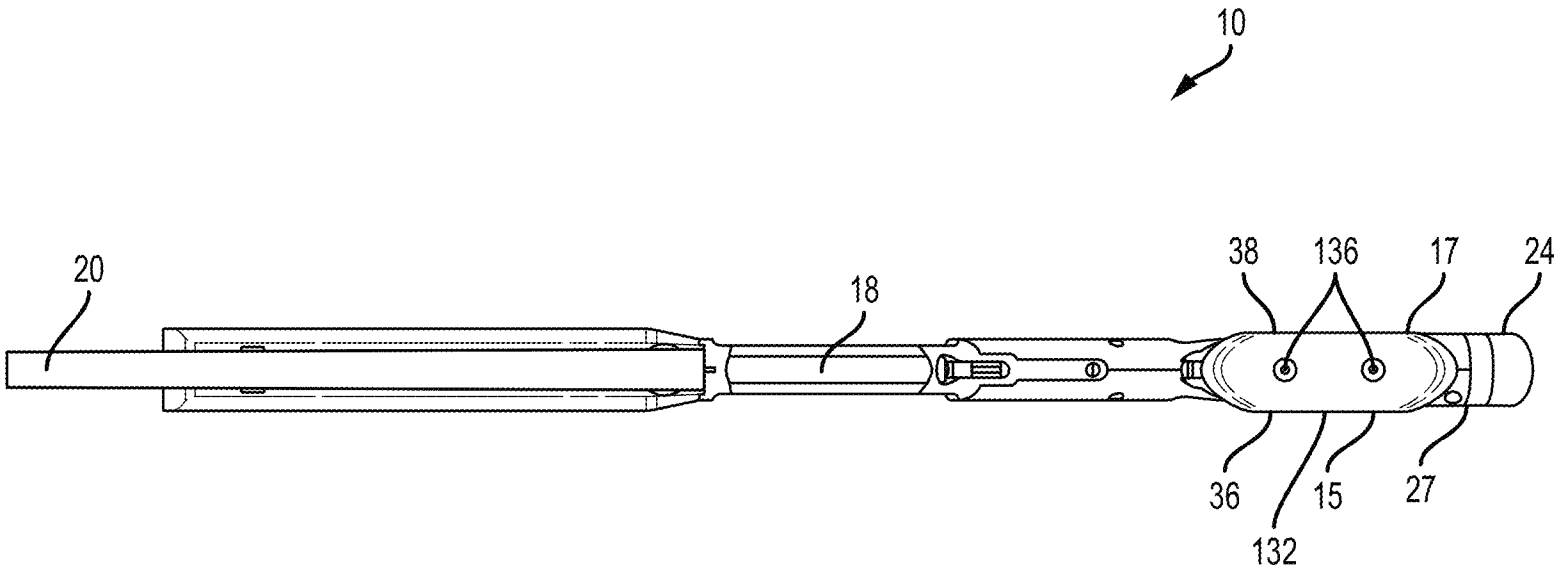
FIGS. 3A-3D are, respectively, top plan, left-side elevation, bottom plan, and right-side elevation illustrative views of the firearm and example embodiments of the firearm stock and associated components.
Figure 3B:
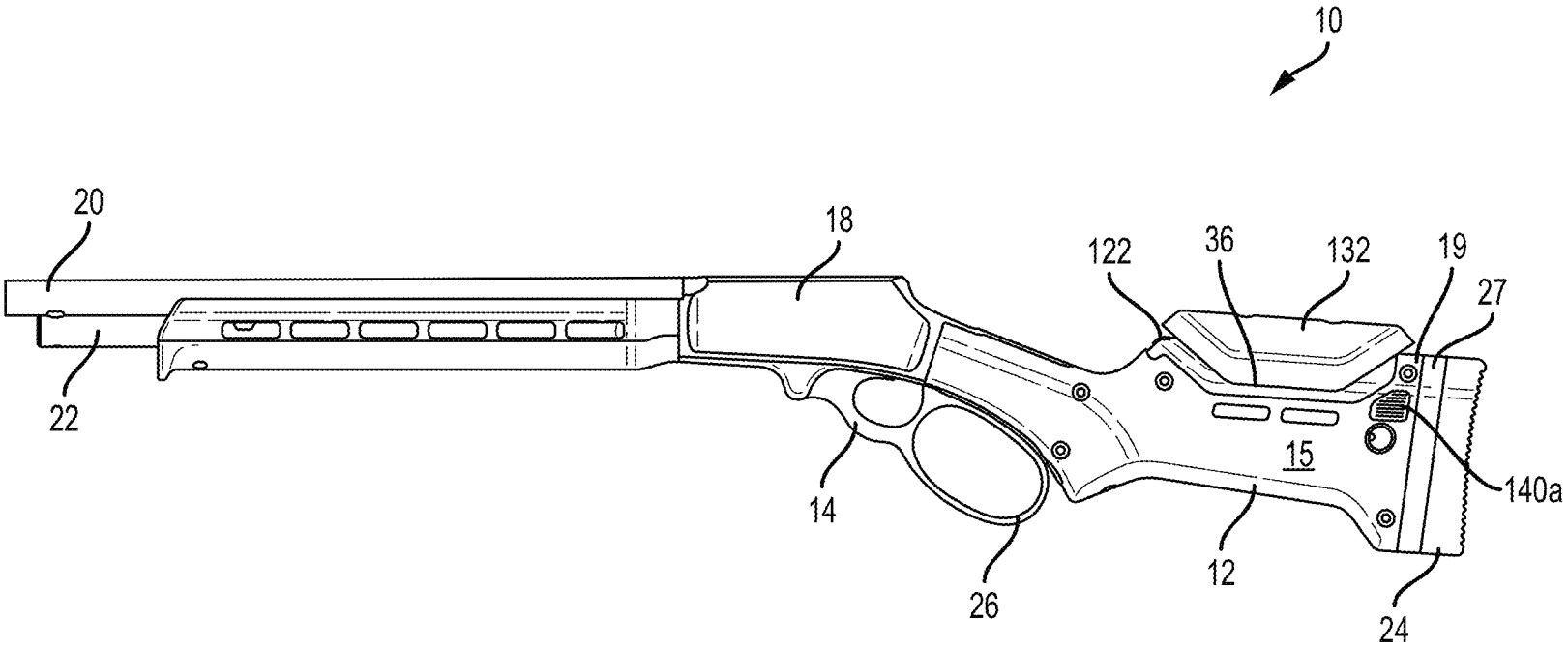
Figure 3C:
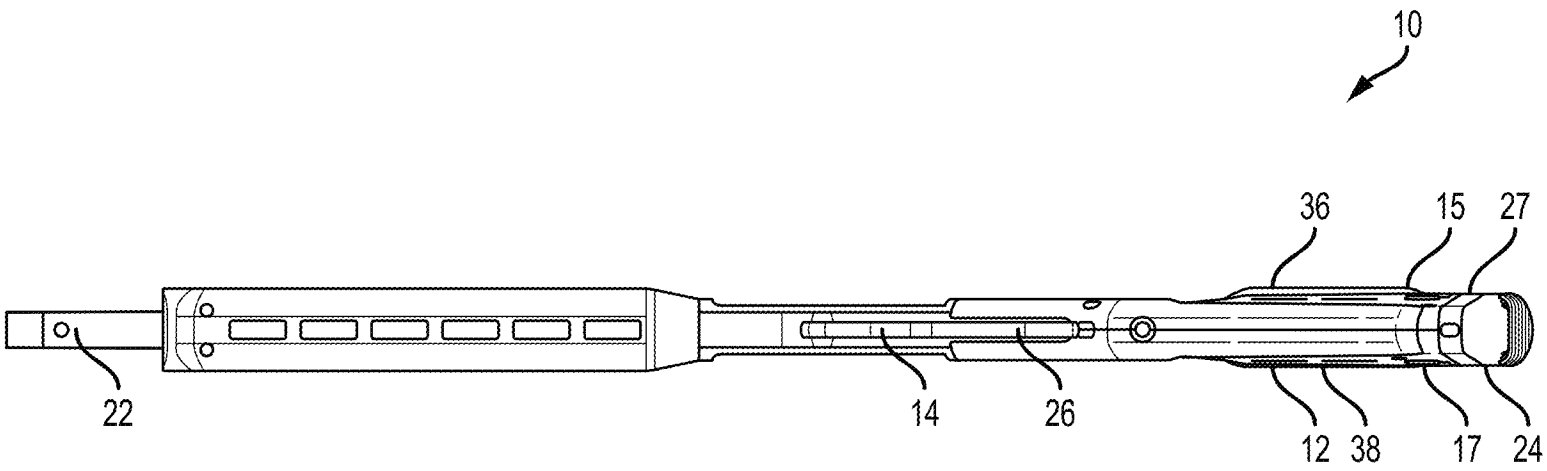
Figure 3D:
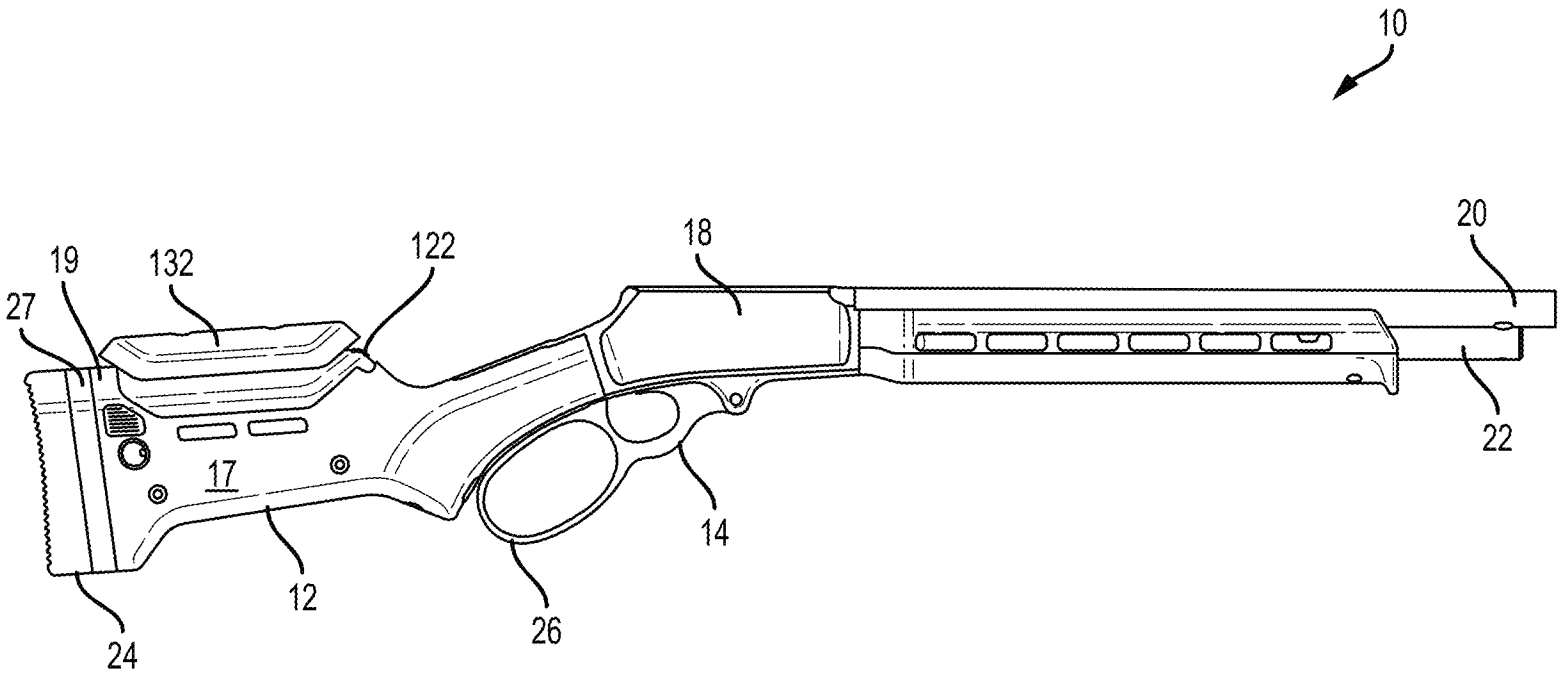
Figure 4A:
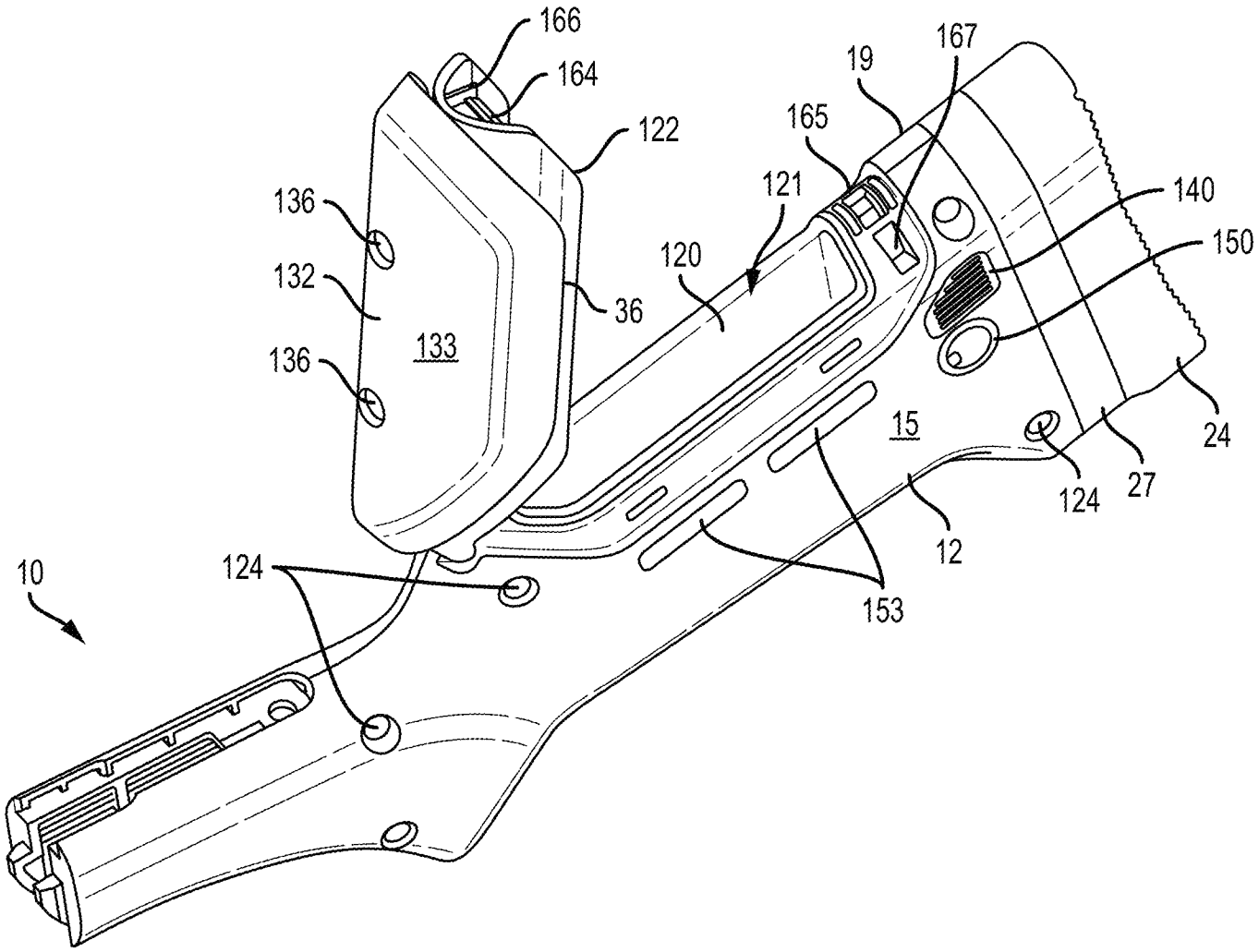
FIGS. 4A-4B are, respectively, an upper front left-side perspective view and an upper rear right-side perspective view, of an illustrative portion of a firearm including an example firearm stock and associated components.
Figure 4B:
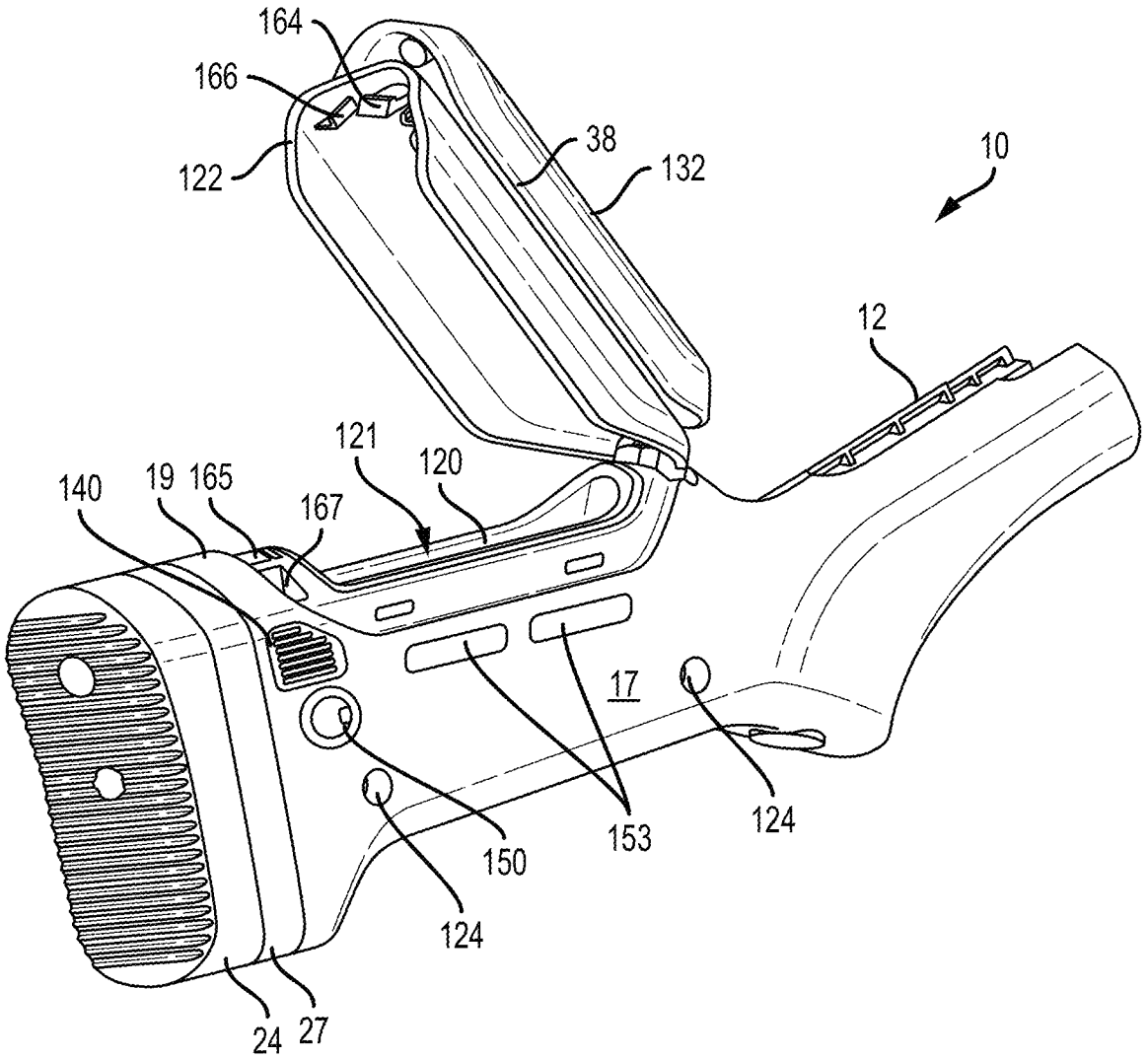

FIGS. 4A-4B are, respectively, an upper front left-side perspective and an upper rear right-side perspective, of an illustrative portion of a firearm 10 including an example firearm stock 12 and associated components. In the embodiments of FIGS. 4A-4B, the storage lid 122 is in the open position. As illustrated in these figures, the example firearm stock 12 comprises a storage cavity 120 that may be at least partially covered by the storage lid 122 when the storage lid 122 is in the closed position. The storage lid 122 may interface with the cheek riser 132 (e.g., part of a cheek riser system), which in various embodiments may be attached to the storage lid 122 using screws 136, though other attachment or coupling means such as glue, glue and screws, bolts and nuts, etc. can also be used (i.e., a wide variety of fasteners). The storage lid 122 may be spring loaded or otherwise biased toward an open position as shown, for example, in FIGS. 4A and 4B, and in some embodiments, lid button 140 may release storage lid 122 from a closed position (see, for example, FIGS. 1-3D).

Figure 4C:
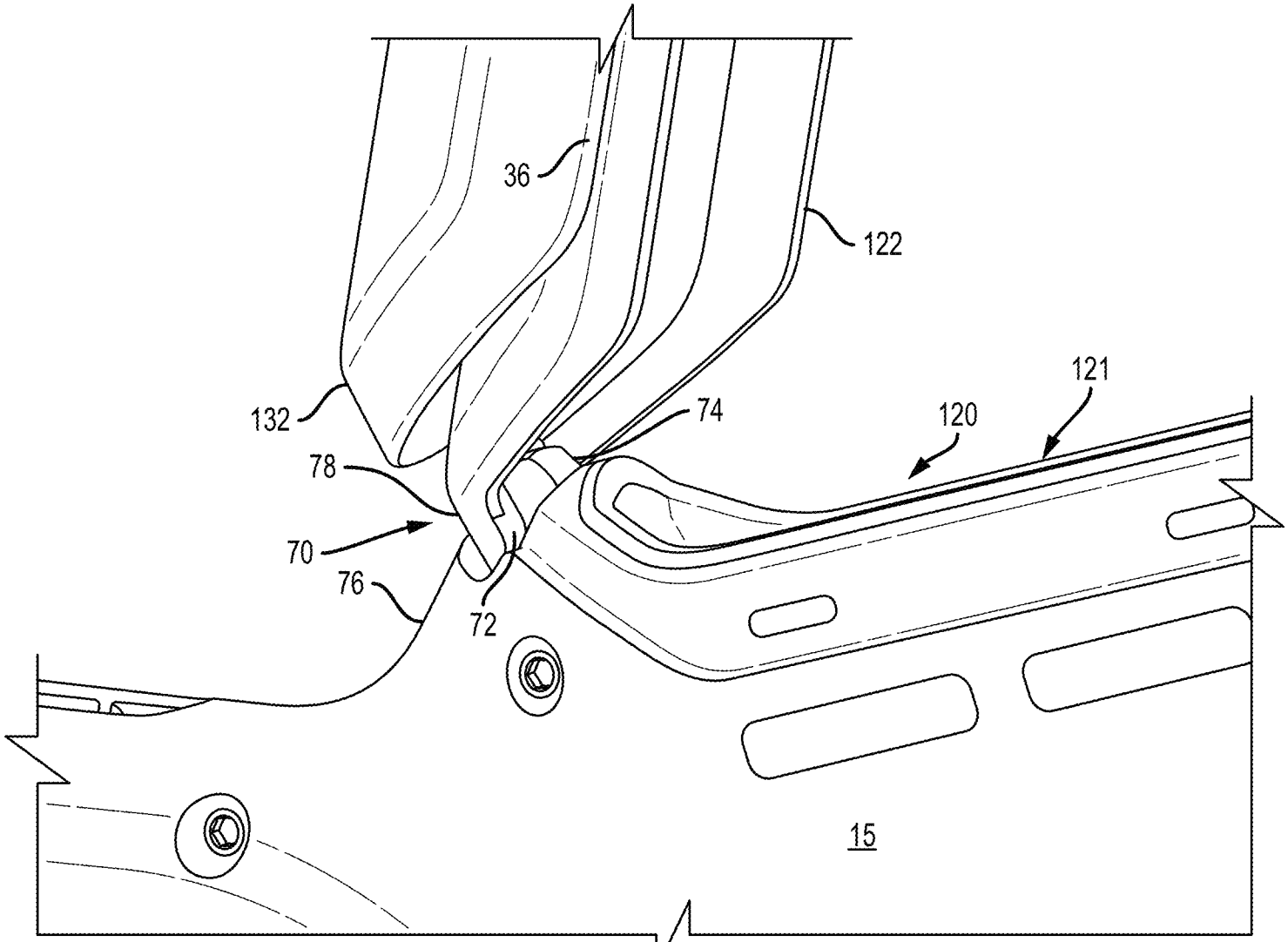
FIG. 4C is side perspective view of an illustrative portion of a firearm including a pivot mechanism that enables a storage lid to pivot relative to an opening of a storage cavity.

The storage lid 122 and attachment mechanisms may enable the storage lid 122 to transition between an open position and a closed position relative to an opening 121 of the storage cavity 120 as described herein. The opening 121 is a portion of the storage cavity 120 that may be at least partially covered by the storage lid 122 when the storage lid 122 is in the closed position. In some embodiments, such as the embodiment of FIG. 4C, the attachment mechanism may include a pivot mechanism 70 configured to enable the storage lid 122 to pivot between the open position and the closed position. The pivot mechanism 70 may include a rod 72 that is rotatable within the firearm stock 12, which enables the storage lid 122 to pivot between the open position and the closed position. In some embodiments, the rod 72 may be rotatable within a portion of the comb 19. The pivot mechanism 70 may include a biasing mechanism 74 that is configured to bias the storage lid 122 toward the open position. For example, spring devices or the like may be located in the biasing mechanism 74 and may apply a force between a body portion of the firearm stock 12 and the storage lid 122 to bias the storage lid 122 toward the open position. In some embodiments, the rod 72 may be at least partially received and/or rotatable in the biasing mechanism 74.

The comb 19 may have a surface portion 76 located forward of the storage lid 122 and the storage lid 122 may have a surface portion 78 located proximate the surface portion 76. When the storage lid 122 is in the closed position, the surface portion 76 may be flush with the surface portion 78. For example, when the storage lid 122 pivots to the closed position, the surface portion 76 and the surface portion 78 may form a flush surface.

The storage lid 122 and body portion of the firearm stock 12 may have a latch system secure the storage lid 122 in the closed position. For example, the latch system may include one or more guides 166 that help position the storage lid 122 onto the stock 12 and/or help position the storage lid 122 in the closed position. For example, the guides 166 may position the storage lid 122 over the opening 121 when the storage lid 122 transitions to the closed position. In some aspects, as the storage lid 122 is maneuvered into the closed position, the guides 166 may align and insert into guide receptacles 167 as the latch 164 is maneuvered into position against a latch lever 160 (FIG. 5) through receptacle 165, as described herein. Accordingly, the latch 164 may be receivable into the receptacle 165 to maintain or secure the storage lid 122 in the closed position. Mechanisms may be located in or below the receptacle 165 that retain the latch 164 in the receptacle 165 until the mechanisms are activated to release or disengage the latch 164 from the receptacle 165. In various embodiments, guide receptacles 167 and receptacle 165 are openings or holes extending at least partially into, or entirely through, structure(s) in the firearm stock 12 (e.g., holes in the body of the firearm stock 12). When in the closed position, the storage lid 122 may be secured by the latch 164 that interfaces or engages with the latch lever 160 (shown, for example, in FIGS. 5 and 6B-7B) that is partially or fully within the body of the stock 12. In certain instances, the latch 164 may have a lip 164*a* (FIG. 6A) and the latch lever 160 may have a lip 161 (FIGS. 6B-6C). The lip 164*a* and the lip 161 may interlock or engage when the storage lid is in the closed position, which keeps the latch 164 snug against the latch lever 160 and maintains the closed position of the storage lid 122. In various aspects, other components may interface with the latch lever 160 to maintain the closed position of the storage lid 122 as described herein.

The body of the firearm stock 12 may have any configuration; for example, the body may be two pieces (e.g., a left and a right piece) that are injection molded and are connected together to form the firearm stock 12 by one or more fasteners (such as one or more screws, e.g., screws 124 though other attachment means such as glue, glue and screws, bolts and nuts, etc. can also be used) and plug 150. The plug 150, in some embodiments, may be a quick-disconnect socket where various accessories can be attached, such as a sling. The recoil pad 24 may be attached to the firearm stock 12 with a spacer 27 positioned in between a butt portion of the firearm stock 12 and the recoil pad 24. Different spacers 27 can be used to achieve different lengths of pull, or one or more thin spacers can be inserted between the spacer 27 and the recoil pad 24 to tailor the length of pull to a given user. In some embodiments, accessory interface slots 153, such as M-LOK slots, can be arranged on sides of the firearm stock 12 below a top lip of storage cavity 120. In the illustrated embodiment, two M-LOK slots 153 are shown on either side of the firearm stock 12. When not in use, plugs 152 (as shown in FIGS. 5 and 6B-6D) can be inserted into these accessory interface slots 153 to prevent dirt and other debris from entering the accessory interface slots 153. When plugs 152 are removed, the accessory interface slots 153 may be used to attach various accessories to the firearm 10.

Figure 5:
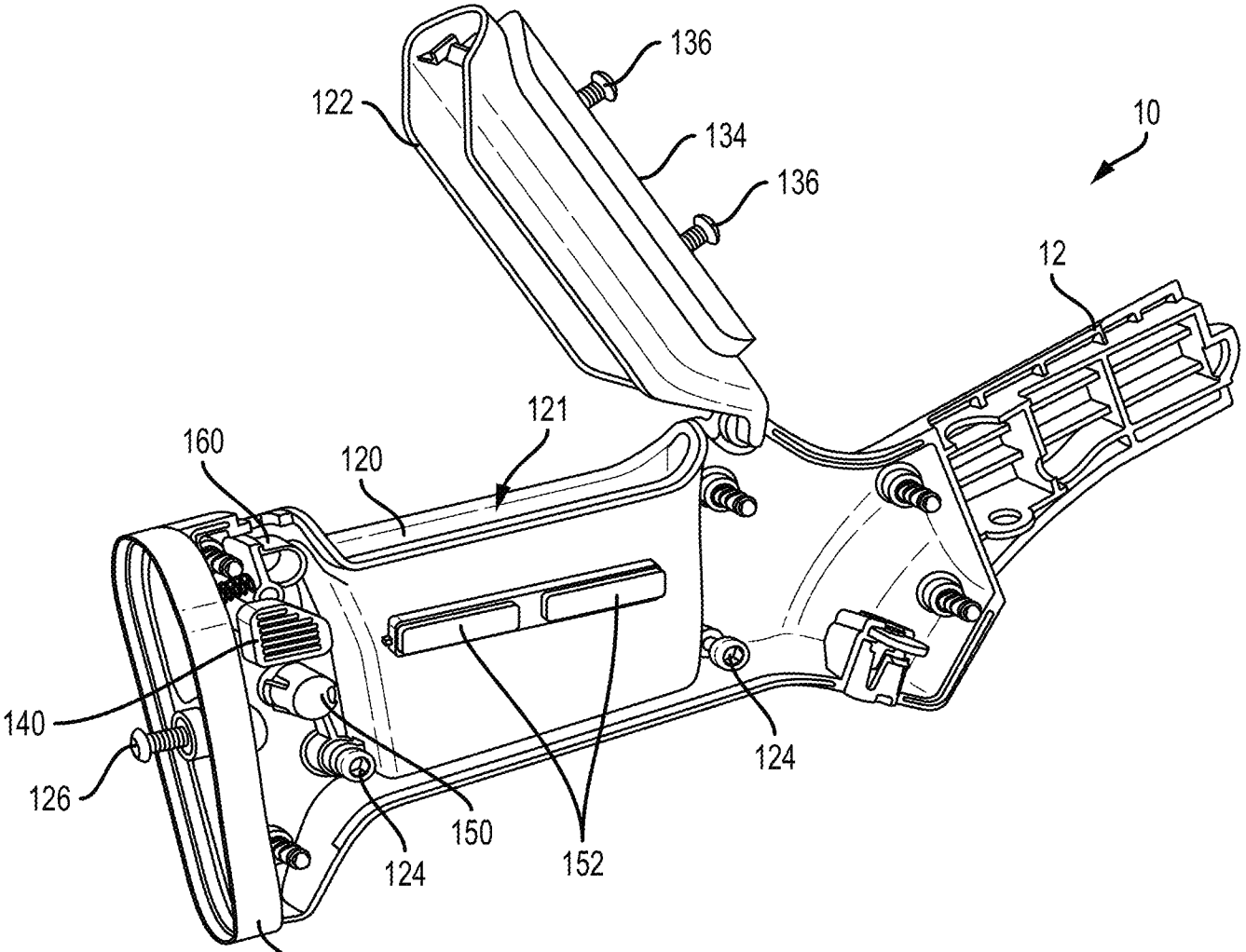
FIG. 5 is an upper rear right-side perspective view of an illustrative firearm with the firearm stock cut away and the recoil pad and the cheek riser not shown.
Figure 7A:
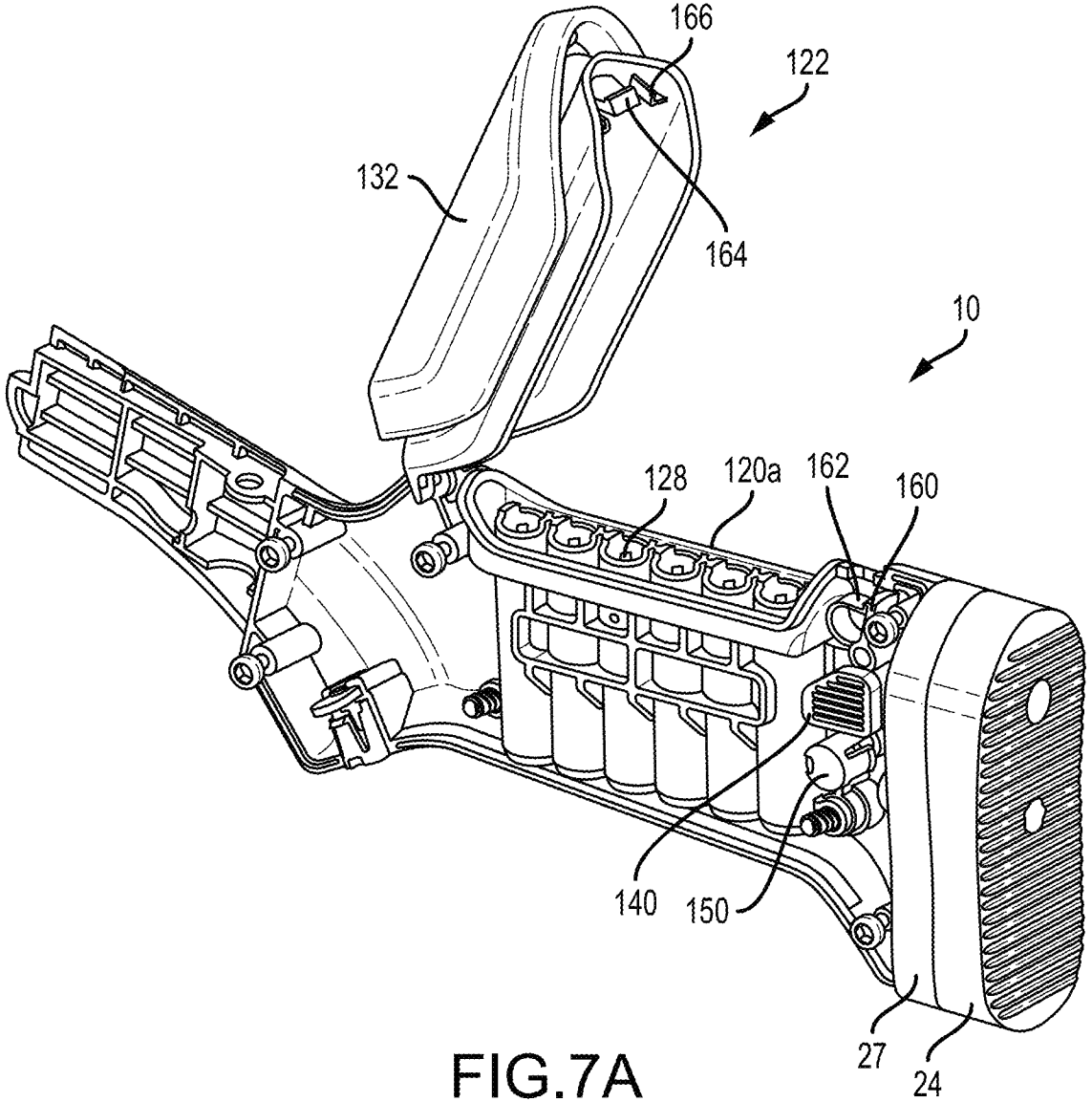
FIG. 7A is an upper rear left-side perspective view of a portion of an illustrative firearm stock including examples of associated components with the body of the firearm stock and some plugs not shown.
Figure 7B:
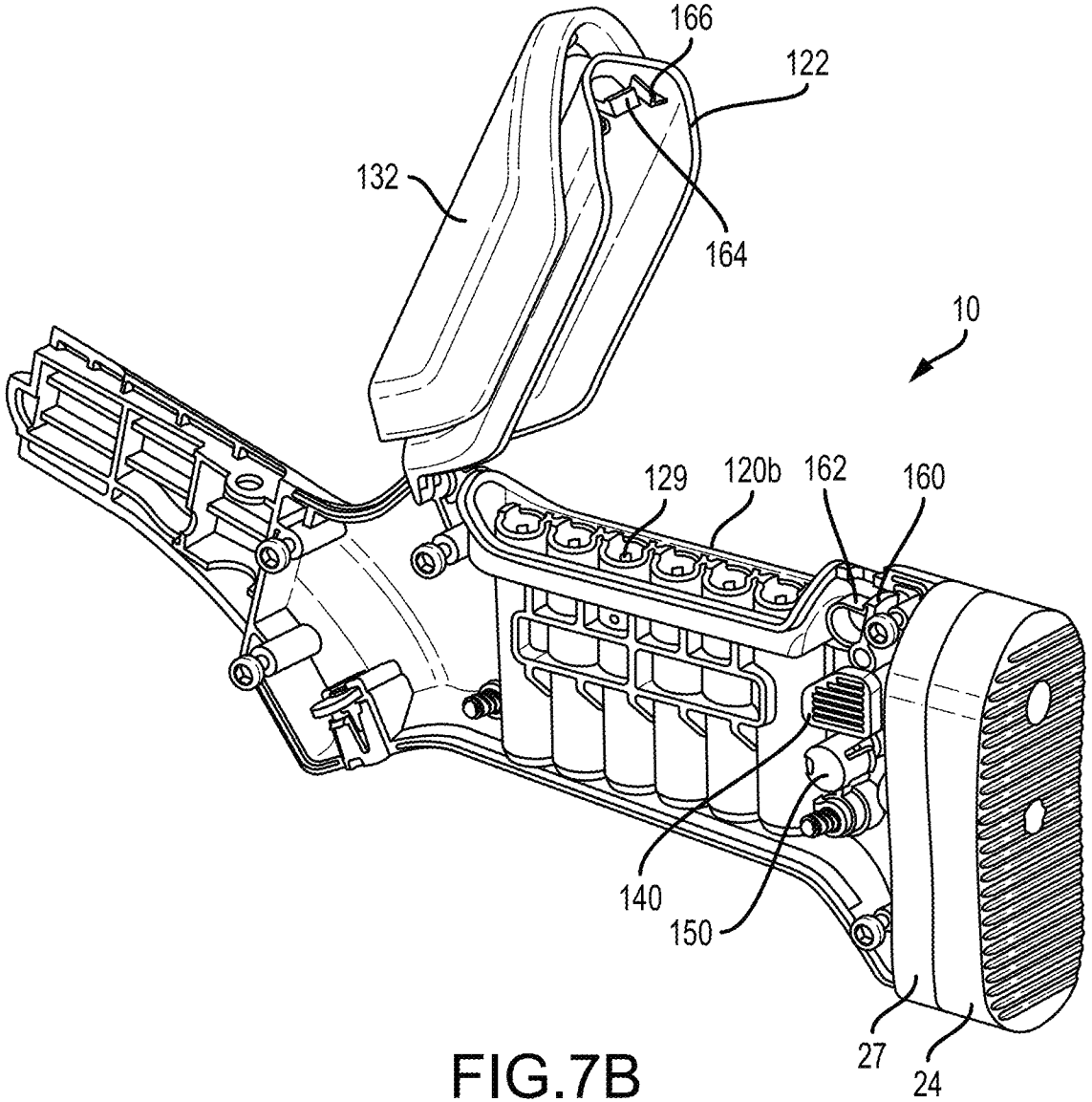
FIG. 7B is an upper rear left-side perspective view of a portion of an illustrative firearm stock including examples of associated components with the body of the firearm stock and some plugs not shown.

FIG. 5 is an upper rear right-side perspective view of an illustrative firearm 10 with the body of the firearm stock 12, the recoil pad, and the cheek riser not shown in order to better illustrate exemplary components of the present disclosure. As illustrated in this figure, the storage cavity 120 is positioned within the firearm stock 12 of the firearm 10 and may include one or more inserts held in place within the body of the firearm stock 12 to provide additional storage. The position of the storage cavity 120 may be advantageous because it may provide, for example, a storage system that is integrated to the firearm 10, additional functionality (e.g., storage capabilities for various items such as ammunition, tools, cleaning supplies, and/or other components useful to a shooter), and ease of access (e.g., via using storage lid 122 that may have an improved accessibility due to location, storage lid 122 release functionality, etc.). In some embodiments, the storage cavity 120 (e.g., fit inside the internal area of the stock body) may provide storage for rounds of various calibers of ammunition as described herein (e.g., see FIGS. 7A and 7B showing storage for six rounds of ammunition in two different calibers).

Various components may incorporate, partially or fully, additional advantageous properties. For example, they may be made of one or more lightweight polymer materials. Polymer materials may advantageously reduce weight of one or more of the components described herein and/or advantageously allow a shooter to add utility and tactical functionality via several slots (e.g., a slot associated with plug 152 and/or accessory interface slots 153 as seen in FIGS. 4A and 4B) that provide for the optional and removable attachment of accessories. Advantageously, accessories may be easily and quickly interchangeable by use of the slots as described herein.

Although the recoil pad 24 (FIG. 1) is not shown in FIG. 5, this figure shows how the recoil pad 24 may be attached to the butt of the firearm stock 12 with a spacer 27 positioned in between. In some aspects, a screw 126 or other fastener extends through the recoil pad 24 and the spacer 27 to hold them securely against the butt of the firearm stock 12. In some embodiments, the recoil pad 24 together with the spacer(s) (e.g., spacer 27) and any fastening means may be referred to as a length of pull adjustment system. In various embodiments, the length of pull adjustment may be advantageously user customizable by installing one or more spacers 27, which each may have the same or differing thicknesses, between the stock body and the recoil pad 24. As discussed herein, the spacer(s) 27 may be made of any material such as a lightweight polymer material. Further, the spacer(s) 27 may have any size and shape; in some embodiments, the spacers 27 may have a size similar to the butt-end of the body of the firearm stock 12 and/or the recoil pad 24, and they may have any thickness.

Additional reference is made to FIG. 4B. Embodiments disclosed herein may include the cheek riser 132 attached to the storage lid 122. FIG. 4B shows a cheek surface 133 on the cheek riser 132, wherein the cheek surface 133 is configured to contact a cheek of a shooter. FIG. 5 does not show the cheek riser 132; however, FIG. 5 shows a spacer 134 that may be arranged between the cheek riser 132 and the storage lid 122. In certain aspects, one or more screws 136 or other fasteners extend through the cheek riser 132 and the spacer 134 to hold them securely against the storage lid 122. In various embodiments, the height of the cheek riser 132 may be advantageously user customizable. For example, a distance between the storage lid 122 and the cheek riser 132 and/or the cheek surface 133 may be adjustable. In some embodiments, distance between the storage lid 122 and the cheek surface 133 may be movable between a first distance and a second distance. In some embodiments, the distance between the storage lid 122 and the cheek riser 132 is at least partially dependent on a number and/or dimension of spacers 134 located between the storage lid 122 and the cheek riser 132. The adjustment of the cheek riser 132 may be performed by installing one or more of the spacers 134 between the cheek riser 132 and the storage lid 122.

Each spacer 134, if more than one is used, may have a same or differing thickness. As discussed herein, the spacer(s) 134 may be made of any material such as a lightweight polymer material. Further, the spacer(s) 134 may have any size and shape; in some embodiments, the spacers 134 may have a size similar to the cheek riser 132 and/or the storage lid 122, and they may have any thickness (e.g., a ¼ inch thickness for each spacer). In some embodiments, the cheek riser 132 together with the spacer(s) (e.g., spacer 134) and any fastening means (e.g., screws 136) may be referred to as a cheek height riser system. The cheek riser 132 may advantageously be adjustable in height for a user to choose a custom height adjustment, for example so that the user may account for various optics mounted to the firearm 10.

The cheek height riser system is illustrated as an asymmetric design (e.g., see the cheek riser 132 in FIG. 3A) to provide more cheek support on the preferred side, while minimizing interference with additional external storage on the far side. For instance, at FIG. 3A one sees that the cheek riser material favors the left side of the firearm 10 and is thus properly placed for a right-handed shooter. Yet, the location of the cheek riser fasteners is such that the cheek riser 132 can be reversed to suit either left or right-handed shooters (in other words, the system is ambidextrous). For instance, the fasteners may be offset from a centerline passing longitudinally along the spacer 134. Alternatively, a symmetrical design may be used (e.g., may be symmetrically mounted) and may be advantageously ambidextrous (e.g., advantageously the storage lid 122 and/or cheek riser 132 may adapt to both right-handed and left-handed shooters). In various embodiments, the spacer(s) 134 for the cheek riser 132 can adjust the cheek riser 132, for instance, a total of ¾ inch above the stock body and/or the storage lid 122.

Additional reference is made to FIGS. 3A and 3C to show examples of relations between the cheek riser 132 and the body of the firearm stock 12, including the comb 19. The cheek riser 132 may have a cheek riser first side 36 located proximate the first side 15 of the stock 12. In some embodiments, at least a portion of the cheek riser first side 36 may extend past at least a portion of the comb 19 when the storage lid 122 is in the closed position. Such an embodiment may be used by a right-handed shooter who rests his or her cheek proximate the cheek riser first side 36. In other embodiments, the cheek riser second side 38 may extend past at least a portion of the comb 19. Such an embodiment may be used by a left-handed shooter who rests his or her cheek proximate the cheek riser second side 38. In other embodiments, both the cheek riser first side 36 and the cheek riser second side 38 may extend past the comb 19. This embodiment of the cheek riser 132 may provide ambidextrous use of the cheek riser 132.

The cheek riser 132 may be symmetrical as described above or asymmetrical wherein one side of the cheek riser 132 extends beyond the opposite side of the cheek riser 132. In the embodiment of FIGS. 4A and 4B, the cheek riser first side 36 extends further toward the comb 19 or over the storage lid 122 than the cheek riser second side 38. For example, the cheek riser 4 first side 36 may extend proximate the first side 15 of the firearm stock 12. Such a configuration may enable a right-handed shooter to place his or her right cheek proximate the cheek riser first side 36. In some embodiments, the orientation of the cheek riser 132 may be reversed so the cheek riser first side 36 extends toward the second side 17 of the firearm stock 12. Such a configuration may enable a left-handed shooter to place his or her left cheek proximate the cheek riser first side 36.

Figure 6A:
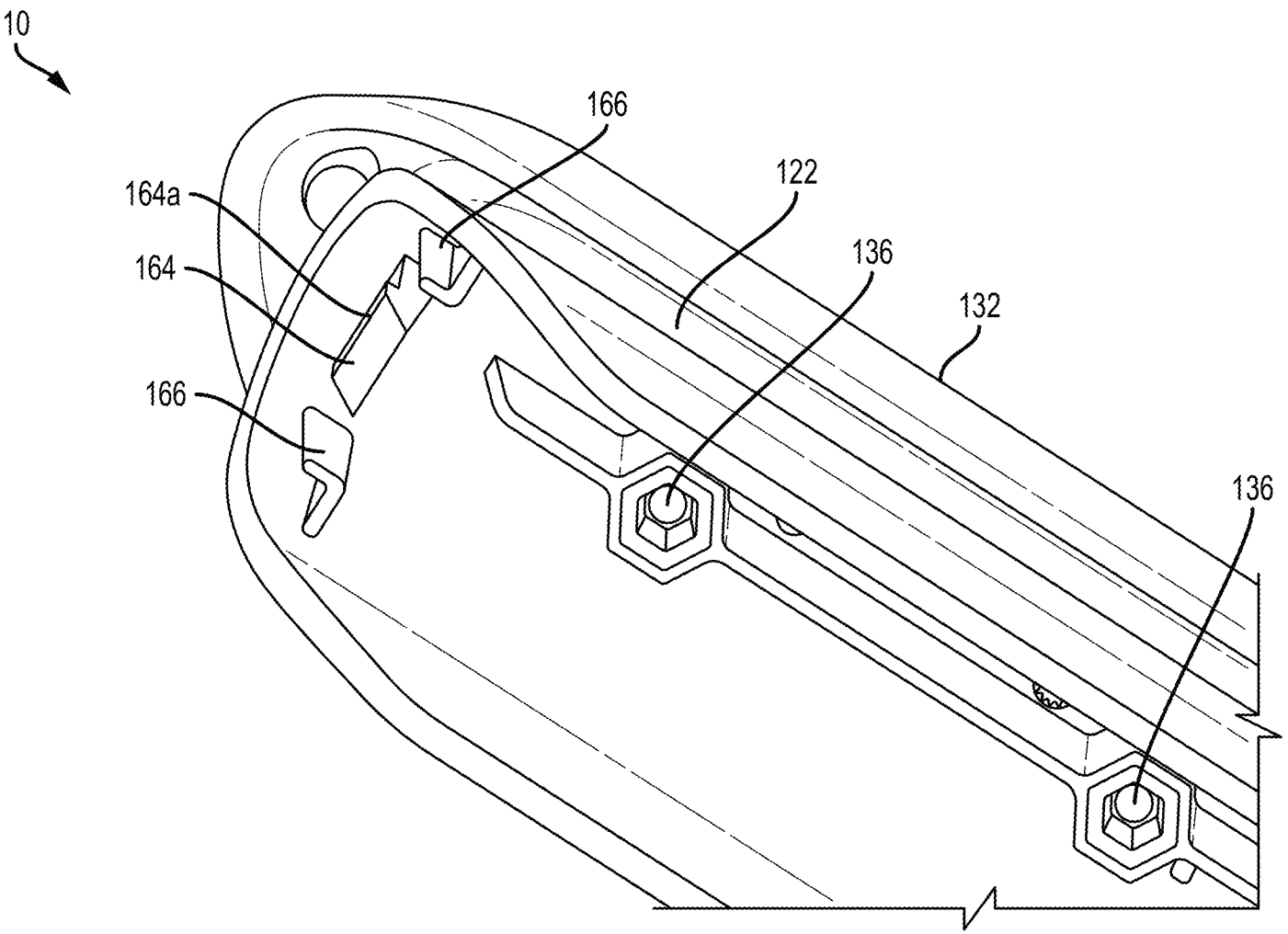
FIG. 6A is a lower front right-side perspective view of an illustrative portion of an example storage lid of a storage cavity of a firearm.
Figure 6B:
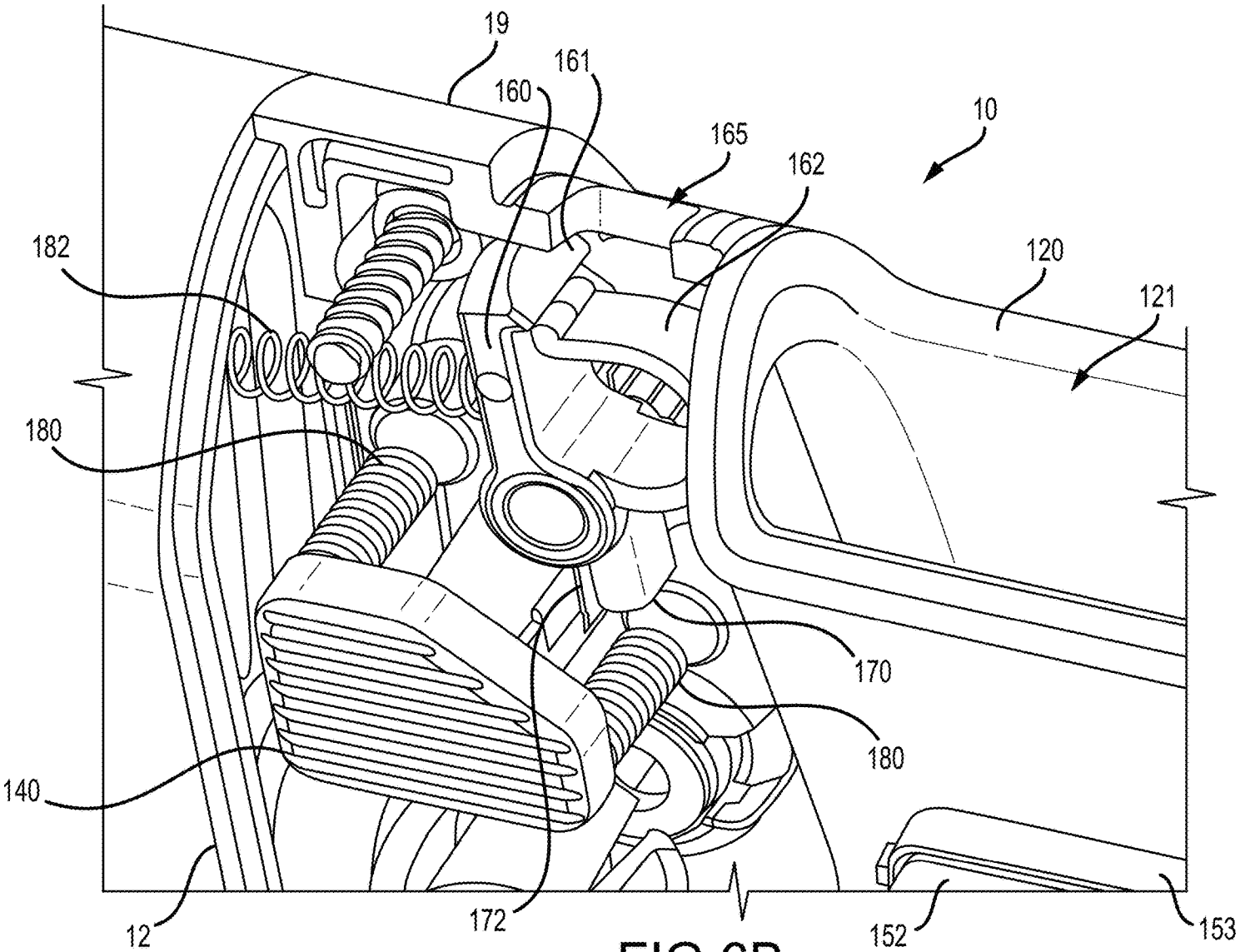
FIG. 6B is an upper front right-side perspective view of an illustrative portion of the interior of a firearm stock with a portion of the exterior of the firearm stock cut away.
Figure 6C:
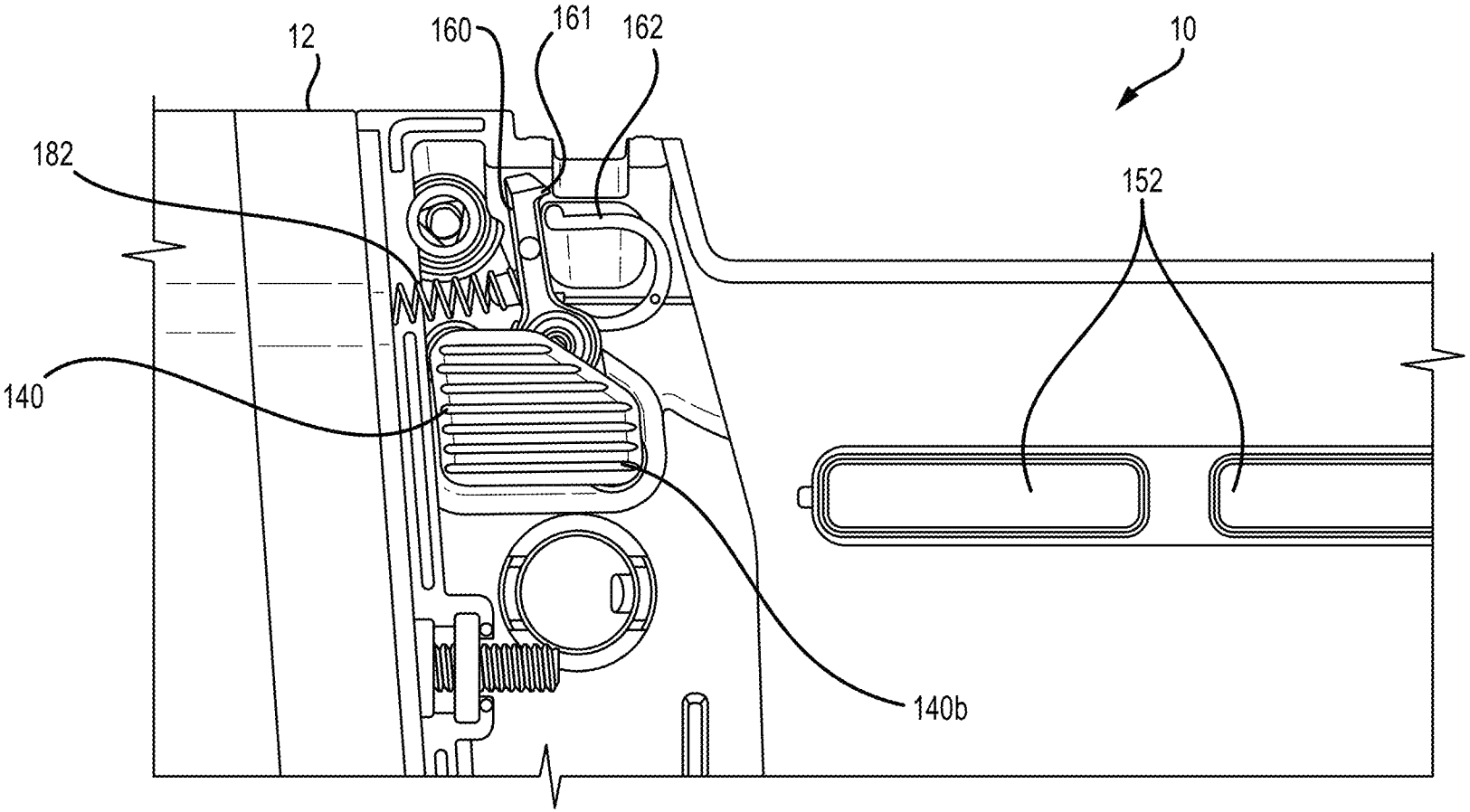
FIG. 6C is a right-side elevation view of an illustrative portion of the interior of a firearm stock with portion of the exterior of the firearm stock cut away.

FIG. 6A is a lower front left-side perspective view of an illustrative portion of an example storage lid 122 of a firearm. As shown in this figure, the storage lid 122 may include one or more guides 166 that help position the storage lid 122 over the opening 121 of the storage cavity 120 and surround a portion of the stock body when the storage lid 122 is in a closed position. When in the closed position, the storage lid 122 may be secured by a latch 164 that interfaces or engages with a latch lever 160 that is within the body of the stock (described further, for example, in FIG. 6B together with its associated text).

Figure 6D:
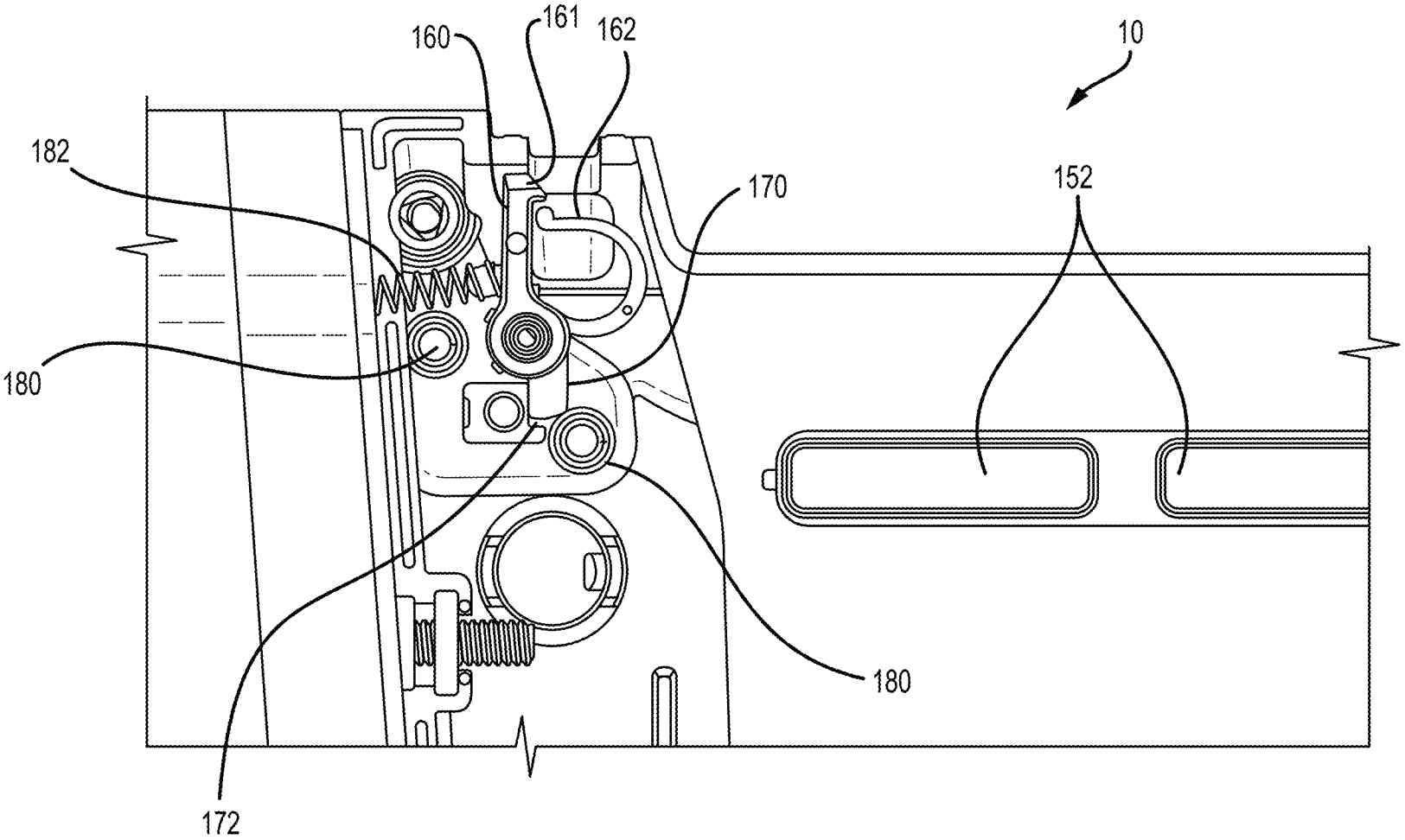
FIG. 6D is a right-side elevation view of an illustrative portion of the interior of a firearm with the body of the firearm stock and the lid button not shown.

FIG. 6B is an upper front right-side perspective of an illustrative portion of the interior of a firearm 10 with the body of the firearm stock 12 cut away in order to better show exemplary components of the present disclosure. FIG. 6C is a right-side elevation view of an illustrative portion of the interior of the firearm 10 with the body of the firearm stock 12 cut away in order to better show exemplary components of the present disclosure. FIG. 6D is a right-side elevation view of an illustrative portion of the interior of the firearm 10 with the body of the firearm stock 12 cut way and a lid button 140 (FIG. 6B) not shown in order to better show exemplary components of the present disclosure.

As illustrated in these figures, the storage cavity 120 may be positioned adjacent the latch lever 160 and components associated with the latch lever 160 (e.g., a spring 182 and a lid button 140). In various embodiments, the storage lid 122 (not shown in FIGS. 6B-6D) interfaces with one or more buttons (e.g., lid button 140) to release the storage lid 122 from the closed position to the open position in response to movement of the lid button 140. The lid button 140 may be a single mechanism with a first side 140*a* and a second side 140*b*, wherein the first side 140*a* is accessible by a shooter from the first side 15 of the firearm stock 12 and the second side 140*b* is accessible by a shooter from the second side 17 of the firearm stock 12. For example, the first side 140*a* and the second side 140*b* may both extend from the firearm stock 12 or may be flush with the first side 15 and/or the second side 17 of the firearm stock 12. In other embodiments, portions of the lid button 140 corresponding to the first side 140*a* and the second side 140*b* may be individual lid buttons that are both operable to release the storage lid 122 from the closed position to the open position. For example, as shown in FIG. 6B, when the lid button 140 is activated or moved from either the first side 140*a* or the second side 140*b*, the lid button 140 may cause latch lever 160 to rotate counterclockwise and cause the lip 161 of latch lever 160 to move away or disengage from the latch 164 and thereby release the storage lid 122 from a closed position into an open position.

When the storage lid 122 is in the closed position, spring 182 may keep the latch lever 160 in a locking position so that the lip 161 remains snug against the latch 164 until the lid button 140 is activated (e.g., depressed or moved) to open the storage lid 122. The storage lid 122 itself may be spring loaded to improve functionality (e.g., faster opening of the storage lid 122, improved opening distance of the storage lid 122 from the storage cavity 120, etc.). For example, a spring portion 162 of the latch lever 160 may be forced downward by the latch 164. When the latch 164 disengages from the latch lever 160, the spring portion 162 may force the storage lid 122 off the comb 19, which may enable a shooter to readily grasp and open the storage lid 122. Other devices and/or mechanisms may be used to bias the storage lid 122 in the open position. In some embodiments, the spring 182 can be formed from a polymer or metal.

In some aspects, the storage lid 122 may be actuated by a shuttle style button system (e.g., lid button(s) 140, latch lever 160, and latch 164) used in conjunction with a spring bias on the storage lid 122 to release the storage lid 122 from a closed position. For instance, and as seen in FIG. 6D, which illustrates the stock body and the second side 140*b* of the lid button 140 cut away, the lid button(s) 140 include a first notch 172 into which a bottom extension 170 of the latch lever 160 resides in a relaxed (e.g., resting) position (e.g., naturally rests when the spring 182 is a lone bias on the latch lever 160). In this state, the latch lever 160 may rotate counterclockwise as the storage lid 122 is closed and the lip 164*a* engages the lip 161. The latch lever 160 may then rotate clockwise so the lip 164*a* is secured by the lip 161, which secures the storage lid 122 in the closed state.

As one or more of the lid buttons 140 are depressed, the lid buttons 140 move laterally (e.g., perpendicular to an axis through the firearm barrel) causing the bottom extension 170 of the latch lever 160 to be forced forward and out of the first notch 172 and rotate counterclockwise (when viewed from the right as in FIGS. 6B-6D). This in turn pulls the lip 161 back from the latch 164 (FIG. 6A) and allows the storage lid 122 to open. When the lid buttons 140 are released, the springs 180 bias the lid buttons 140 back into a starting position (e.g., flush or in a position close to flush with the first side 15 and/or the second side 17 of the firearm stock 12). As the lid buttons 140 return to the starting position, the bottom extension 170 of the latch lever 160 is able to return to the first notch 172 and the latch lever 160 also returns to a starting or relaxed position as shown in FIG. 6D. This configuration also allows the storage lid 122 to be closed without moving the lid buttons 140, since the lip 164*a* of the latch 164 contacts an angled top portion of the lip 161 and rotates the latch lever 160 (e.g., the bottom extension 170 moving forward and away from the first notch 172) when the latch 164 is received in the receptacle 165. The latch lever 160 can then rotate back toward the relaxed position once the latch 164 has cleared the lip 161, and this resting position locks the storage lid 122 into the closed position.

FIG. 7A is an upper rear left-side perspective view of a portion of an illustrative firearm including another example firearm stock and associated components with the body of the firearm stock and some plugs not shown in order to better show exemplary components of the present disclosure. FIG. 7B is an upper rear left-side perspective view of a portion of an illustrative firearm including a further example firearm stock and associated components with the body of the firearm stock and some plugs not shown in order to better show exemplary components of the present disclosure. In FIG. 7A, an illustrative storage cavity 120*a* may hold six rounds of 30-30 caliber ammunition in storage compartments 128, which may be inserts that are insertable within the storage cavity 120*a*. Various configurations of the storage insert are possible, including the ability to hold one or more various types of ammunition. For example, in FIG. 7B, the illustrative storage cavity 120*b* may hold six rounds of 45-70 caliber ammunition in storage compartments 129. In further aspects of the present disclosure, the storage cavity (e.g., 120, 120*a*, 120*b*) may be configured to hold other components, such as tools, cleaning supplies, etc. Advantageously, the storage cavity 120, 120*a*, 120*b* may include inserts that may be user removable and user installed, providing improved flexibility and use of the interior of stock 12 as well as advantageous speed in changing storage cavities that have different functionality.

Various embodiments of the storage cavity 120 and the storage lid 122 may provide advantageous aspects to a user of the firearm 10. For example, the release functionality of the storage lid 122, as described herein, may advantageously provide improved speed of access and accessibility to the storage cavity 120, 120*a*, 120*b* and its contents. It may be advantageous that components associated with the storage cavity 120, 120*a*, 120*b* and/or the storage lid 122 are contained within the firearm stock 12 of the firearm 10 such that the firearm 10 has a lower profile and improved styling even while providing improved functionality. Further, as discussed herein, more than one lid button 140 may be configured for use on the firearm 10 (e.g., as shown in FIGS. 4A and 4B, there may be a lid button 140 on each side of firearm 10, thereby providing improved ease of use as well as ambidextrous functionality). The ambidextrous functionality may advantageously extend to other features, as described herein. For example, the slots (e.g., the slot associated with plug 150 and/or accessory interface slots 153) may be provided so that the user may mount other accessories to the stock while still being adaptable to ambidextrous use. Additionally, the length of pull adjustment system and the cheek riser system may have ambidextrous functionality.

Advantageously, one or more of the systems and methods disclosed herein may be provided at the same time. For example, a firearm 10 may have a firearm stock 12 that has a storage insert, such as within the storage cavity 120, with a releasable lid, and/or ambidextrous buttons, and/or a spacer or spacers to adjust a length of pull and/or a cheek height riser. Various embodiments as disclosed herein may advantageously improve styling and/or provide an improved (e.g., lesser) profile of components of the firearm (e.g., provide an improved stock that increases functionality for the user without increasing a profile of the stock). Further advantageous embodiments may improve a user experience of using a firearm 10 (e.g., by providing a customized length of pull and/or a customized cheek riser height), may improve a storage functionality of the firearm 10, and/or may improve functionality to account for scopes or other optical systems that the user desires to use with the firearm 10, among other advantages.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A firearm stock comprising:

a comb;

a storage cavity comprising an opening extending through at least a portion of the comb;

a storage lid configured to at least partially cover the opening; and a cheek riser attached to the storage lid, wherein the storage lid has an open position and a closed position relative to the opening.

2. The firearm stock of claim 1, further comprising a biasing mechanism coupled to the storage lid, wherein the biasing mechanism biases the storage lid in the open position.

3. The firearm stock of claim 1, further comprising a pivot mechanism coupled to the storage lid, the pivot mechanism configured to enable the storage lid to pivot between the open position and the closed position.

4. The firearm stock of claim 1, further comprising a receptacle, wherein the storage lid further comprises a latch receivable into the receptacle, wherein the latch is configured to maintain the storage lid in the closed position when the latch is received in the receptacle.

5. The firearm stock of claim 4, further comprising a latch lever configured to engage the latch when the latch is received in the receptacle, wherein engagement between the latch lever and the latch maintains the storage lid in the closed position.

6. The firearm stock of claim 5, further comprising a lid button located proximate the latch lever, wherein movement of the lid button disengages the latch from the latch lever.

7. The firearm stock of claim 6, wherein the lid button is accessible from a first side of the firearm stock.

8. The firearm stock of claim 6, wherein the lid button is accessible from a first side of the firearm stock and a second side of the firearm stock, the first side being opposite the second side.

9. The firearm stock of claim 1, wherein the cheek riser comprises a cheek riser first side, and wherein at least a portion of the cheek riser first side is configured to contact a first cheek of a shooter when the storage lid is in the closed position.

10. The firearm stock of claim 1, wherein the cheek riser further comprises a cheek riser second side located opposite the cheek riser first side, wherein at least a portion of the cheek riser second side is configured to contact a second cheek of the shooter when the storage lid is in the closed position.

11. The firearm stock of claim 1, wherein the cheek riser comprises a cheek surface configured to contact a cheek of a shooter, and wherein a distance between the storage lid and the cheek surface is movable between a first distance and a second distance.

12. The firearm stock of claim 1, further comprising one or more spacers located between the storage lid and the cheek riser, wherein a distance between the storage lid and the cheek riser is at least partially dependent on a number of spacers located between the storage lid and the cheek riser.

13. The firearm stock of claim 1, wherein the storage cavity comprises one or more storage inserts.

14. The firearm stock of claim 1, wherein the storage cavity comprises one or more storage compartments.

15. A firearm stock comprising:

a storage cavity comprising an opening;

a storage lid configured to at least partially cover the opening; and a cheek riser attached to the storage lid, wherein the storage lid has an open position and a closed position, and wherein the storage lid at least partially covers the opening when the storage lid is in the closed position.

16. The firearm stock of claim 15, wherein the cheek riser comprises a cheek riser first side, and wherein at least a portion of the cheek riser first side is configured to contact a first cheek of a user when the storage lid is in the closed position.

17. The firearm stock of claim 16, wherein the cheek riser further comprises a cheek riser second side, and wherein at least a portion of the cheek riser second side is configured to contact a second cheek of the user when the storage lid is in the closed position.

18. The firearm stock of claim 15, wherein the cheek riser comprises a cheek surface configured to contact a cheek of a shooter, and wherein a distance between the storage lid and the cheek surface is movable between a first distance and a second distance.

19. The firearm stock of claim 15, further comprising one or more spacers located between the storage lid and the cheek riser, wherein a distance between the storage lid and the cheek riser is at least partially dependent on a number of spacers located between the storage lid and the cheek riser.

20. The firearm stock of claim 15, further comprising a comb, wherein the opening extends at least partially through the comb.

21. A firearm stock comprising:

a comb;

a storage cavity comprising an opening extending through at least a portion of the comb;

a storage lid having an open position and a closed position, wherein the storage lid at least partially covers the opening when the storage lid is in the closed position;

a pivot mechanism coupled to the storage lid, the pivot mechanism configured to enable the storage lid to pivot between the open position and the closed position; and a cheek riser attached to the storage lid.

* * * * *